US006610176B2

(12) United States Patent
Mauretti

(10) Patent No.: US 6,610,176 B2
(45) Date of Patent: Aug. 26, 2003

(54) CORELESS PAPERMAKER'S YARN

(75) Inventor: Gerald J. Mauretti, Fall River, MA (US)

(73) Assignee: Pascale Industries, Inc., Pine Bluff, AR (US)

( * ) Notice: Subject to any disclaimer, the term of this patent is extended or adjusted under 35 U.S.C. 154(b) by 0 days.

(21) Appl. No.: 09/925,749

(22) Filed: Aug. 9, 2001

(65) Prior Publication Data

US 2002/0088593 A1 Jul. 11, 2002

Related U.S. Application Data

(63) Continuation-in-part of application No. PCT/US00/07106, filed on Mar. 17, 2000.
(60) Provisional application No. 60/125,283, filed on Mar. 19, 1999.

(51) Int. Cl.[7] ..... D21F 7/08; D21F 7/12; D03D 3/04; D02G 3/38

(52) U.S. Cl. ..... 162/358.2; 162/900; 162/902; 57/204; 57/16; 139/425 A; 442/193; 442/195

(58) Field of Search ..... 139/383 A, 383 AA, 139/425 A; 162/306, 348, 358.2, 358.4, 900, 901, 902, 903, 904; 428/222, 364, 365, 371, 374, 375, 377, 397; 442/189, 334, 192, 335, 301, 352, 308, 414, 309, 193, FOR 101, 195; 57/11, 16–18, 204–210

(56) References Cited

U.S. PATENT DOCUMENTS

| | | | | | |
|---|---|---|---|---|---|
| 3,675,409 | A | | 7/1972 | Rosenstein | 57/229 |
| 3,769,787 | A | | 11/1973 | Rosenstein et al. | 57/227 |
| 4,202,382 | A | * | 5/1980 | Westhead | 139/383 A |
| 4,250,702 | A | * | 2/1981 | Gundlach | 57/251 |
| 4,350,731 | A | * | 9/1982 | Siracusano | 139/383 A |
| 5,237,805 | A | * | 8/1993 | Menegatto | 57/16 |
| 5,482,747 | A | | 1/1996 | Hayes et al. | 427/341 |

* cited by examiner

*Primary Examiner*—Steven P. Griffin
*Assistant Examiner*—Eric Hug
(74) *Attorney, Agent, or Firm*—Michael de Angeli

(57) ABSTRACT

A yarn is produced which consists substantially of twisting filaments which are wrapped sequentially upon each other helically upon the yarn in layers, wherein the helically wound filaments preferably are wound right to left and then left to right alternatively to balance the yarn, wherein optionally a glue is applied to one of the filaments to maximize the performance of the yarn in producing paper.

13 Claims, 5 Drawing Sheets

CORELESS PAPERMAKER'S YARN

CROSS-REFERENCE TO RELATED APPLICATIONS

A claim of benefit is made to U.S. Provisional Application Ser. No. 60/125,283 filed Mar. 19, 1999, the contents of which are incorporated herein by reference. This is a continuation-in-part application of the Provisional Application filed Mar. 19, 1999, the contents of which are incorporated herein by reference. This is further a continuation in part application of PCT/US00/07106 filed on Mar. 17, 2000, the contents of which are also herein incorporated by reference.

BACKGROUND OF THE INVENTION (1) Field of the Invention

This invention relates to yarns for use in papermaking fabrics, and more specifically to stuffer yarns used in papermakers' fabrics.

(2) Description of Prior Art

In the early days of papermaking, a paper-forming slurry of particles was deposited on a wire screen. Eventually, that wire screen evolved into a woven fabric woven from yarns. Indeed, because the fabrics are woven, such products that are used on papermaking machines have become known as papermachine clothing. As one can imagine, the properties of the yarns used in weaving papermachine clothing are important, and contribute to the final characteristics of the paper itself.

The usual papermaking machine has three primary sections: a forming section, a press section, and a drying section. In the forming section, a water slurry or suspension of cellulose fibers, known as the paper stock or pulp, is fed onto the top of the upper run of a traveling endless forming belt. The forming belt provides a papermaking surface and operates as a filter to separate the cellulose fibers from the aqueous medium to form a wet paper web. In forming the paper web, the forming belt serves as a filter element to separate the aqueous medium from the cellulose fibers by providing for the drainage of the aqueous medium through its mesh openings, also known as drainage holes, by vacuum means or the like located on the drainage side of the fabric.

From the forming section, the somewhat self-supporting paper web is transferred to the press section of the machine and onto a press felt, where still more of its water content is removed by passing it through a series of pressure nips formed by cooperating press rolls, these press rolls serving to compact the web as well. A press felt generally includes a woven fabric to which a batt material is applied, usually by one or more needling operations, as is known in the art. As will be described herein, the stuffer yarns of the present invention may be used to enhance batt anchorage in a press felt.

After leaving the press section, the paper web is transferred to a dryer section where it is passed about and held in heat transfer relation with a series of heated, generally cylindrical dryer rolls to remove still further amounts of water therefrom. One or more dryer fabrics may be employed to press the moist web uniformly and successively against the dryer cylinders to dry the web. As used herein and in the claims, the term "papermaking machine" is to be considered in a broad or generic sense, that is, the machine producing a paper or paper-like material such as pulp, board, wet laid non-woven sheet or other similar structures.'

In the dryer section, the dryer cylinders are internally heated by steam or the like. The cylinders usually have imperforate surfaces for contacting the paper web. Other rolls, such as pocket rolls, may have surfaces that are perforated or slotted to permit the passage of heated air there through to increase the drying action on the web.

Ideally, dryer fabrics should have at least the following properties. First, they should have a top surface that is fine enough to minimize marking of the sheet of paper being produced. Second, they should have a resilient bottom layer to provide long life while enduring the stress the fabric is subjected to while in contact with the machine over a long period of time. Third, the dryer fabric weave should be open enough to allow heat to pass through without significant impedance. Fourth, the fabric should be designed in such a way that the permeability of the fabric, and thus the heat transfer from the dryer cylinders to the web, may be controlled.

In multi-layer dryer fabrics, it is known in the art that a certain degree of control may be exhibited over the permeability of the woven dryer fabric by inserting additional cross machine direction yarns, called stuffer picks, or stuffer yarns, into the weave at selected positions across the fabric. These yarns serve to fill the air pockets or voids created in the weave between the machine direction and cross machine direction yarns. These stuffer yarns can also serve the supplemental purpose of joining the top and bottom layers of the fabric and lending an increased cohesiveness and durability to a fabric that would otherwise be overly porous and vulnerable to wear.

In the past, several varieties of stuffer yarns have been employed for the purposes noted above. The most common yarns utilized have been cabled monofilament yarns, hollow monofilament, and thermoplastic coated (or deformable) cross-machine-direction yarns. Each of these yarns brings limitations to the dryer fabric application. Specifically, a daunting problem is that none of the three prior art stuffer yarns provide the desired degree of permeability control in the dryer fabric in which a stuffer yarn is used.

In addition, a number of problems specific to the use of cabled yarns as stuffer yarns in a dryer fabric are well known in the art. For example, a major problem is that they are bound tightly and are not able to efficiently fill the interstices of the woven fabric to impede the flow of air, as desired. Furthermore, the cabled monofilament stuffer yarn does not weave efficiently. Undesirable torque builds up during the weaving process that results in pigtails or kinks being pulled into the fabric.

In addition, the diameter and shape of the fibers used in the manufacture of the cabled yarn should be identical. When fibers of varying diameters are twisted into a cabled yarn, the resulting yarn becomes buckled and kinked. The difficulties of incorporating such a yarn into a weave are obvious. Even if it were possible to weave such a yarn into a fabric, the resulting fabric would be uneven and cause marking and non-uniform drying to the paper web. Thus, cabled yarns are limited to fiber bundles of uniform cross section and diameter. The result of this limitation is that cabled yarns have a somewhat uniform radius, and will not fill fabric voids. The result of having fabric voids in papermakers' fabric made with cabled yarns of the prior art is less control over the permeability of the fabric.

Monofilament hollow yarns have also used been used as cross machine direction stuffer picks in dryer fabrics. Further, while hollow monofilaments will distort to fill the fabric voids they will not provide the same effect as the inter-twisted yarns' ability to allow individual monofilaments to disperse in the fabric voids. The major disadvantage of using hollow yarns as stuffer yarns is that such yarns are more difficult to produce than conventional monofilament yarns and, as a result, are significantly more expensive than cabled monofilament or inter-twisted monofilament yarns.

Cross-machine direction yarns that are deformable have been used as stuffer yarns, but like hollow yarns, they are very costly to manufacture. Further, they require special post-treatment to allow the coating to deform to fill the fabric voids.

U.S. Pat. No. 3,675,409 to Rosenstein addressed the problem of pigtails and kinks in a multi-filament fiber bundle, specifically a tow. Rosenstein prevents snags and kinks in a tow through the use of a wrapping filament to keep the tow fibers substantially parallel. The wrapping filaments are wound in a clockwise and counter-clockwise manner to prevent unraveling and loosening of the substantially parallel tow fibers which were then cut for flock. In Rosenstein, the wrapping filaments were limited in their application to ensure that when the tow was chopped they were substantially the same length as the substantially parallel filaments that they bound.

For the foregoing reasons, there is a need for an improved stuffer yarn for use in papermakers' fabrics, and for an improved method of making such a yarn that is fast and economical.

SUMMARY OF THE INVENTION

The present invention satisfies these needs with an improved assembled multifilament stuffer yarn for use in papermakers' dryer fabrics and press felts, utilizing a plurality of monofilament filaments that are helically wrapped or twisted clockwise and counterclockwise to form a papermakers' yarn by wrapping or twisting filaments together. A first "central twisting carrier" serves as the first member of the yarn, and acts as a carrier for the subsequent wrapping of a number of twisting filaments wherein the finished yarn is substantially free of filaments which are parallel.

The yarn is made by passing a first twisting filament or a yarn or a plurality of twisting filaments or a mixture of twisting filaments, hereinafter referred to in the specification and in the claims as the "central twisting carrier" in sequence through the hollow center of a number of static twisting filament-loaded supply spools positioned sequentially in a linear pattern. The majority of the cross-sectional diameter of the finished yarn is made up of the twisting filaments with substantially no filaments parallel to one another.

As the central twisting carrier is passed through the hollow center of each of the subsequent twisting filament-loaded supply spools, the central twisting carrier is helically wrapped by a twisting filament that is pulled off of the supply spool along with the moving central twisting carrier. The supply spools are oriented in positions such that the twisting filament that is pulled off some of the supply spools wraps the central twisting carrier in a clockwise direction, and some of the twisting filaments wrap the central twisting carrier in a counterclockwise direction.

Accordingly, an object of the invention is to provide an improved assembled monofilament yarn for use in a papermaking fabric that will efficiently control the flow of air through the fabric.

A further object of the present invention is to provide an improved assembled monofilament yarn for use in a press felt that provides improved anchorage for needling batt fibers.

Yet another object of the present invention is to provide an improved dryer fabric for the dryer section of a papermaking or similar machine utilizing the inter-twisted monofilament yarns of the present invention as stuffer yarn.

Another object of the present invention is to provide an improved press felt for the press section of a papermaking or similar machine utilizing the multifilament yarns of the present invention for scrim structure substrate.

Yet another object of the invention is to provide a dryer fabric that may be employed to press the moist web uniformly and successively against the dryer cylinders to dry the web.

A further object of the invention is to provide yarns that can be utilized as stuffer picks in a dryer fabric, filling in fabric voids, thereby allowing for improved control of permeability.

Another object of the invention is to provide a yarn that can be utilized in a papermakers' fabric and which provides improved control of heat transfer.

Another object of the invention is to provide a yarn that will impart greater wear resistance and compaction resistance to a press felt made therefrom.

Another object of the invention is to provide an assembled monofilament yarn that can be woven efficiently, without undesirable torque build-up that results in kinks being pulled into the fabric.

A further object of the invention is to provide an improved papermakers' yarn that is less expensive to make than monofilament hollow yarns and other cross-machine-direction yarns.

DETAILED DESCRIPTION OF THE PREFERRED EMBODIMENT

At the outset, the invention is described in its broadest overall aspects with a more detailed description following. The present invention is a multifilament stuffer yarn for use in papermakers' fabrics, and a method of making the stuffer yarn. The improved, yarn has applications for use in the dryer, and press sections of a papermaking machine.

Fibers selected for use in the yarn and fabrics of the present invention may be those commonly used in papermakers' fabrics. The polymer fibers can be selected from the group consisting of polypropylenes, polyesters, aramids or nylon. One skilled in the relevant art will select yarn materials according to the particular application of the final fabric.

Figure 1:
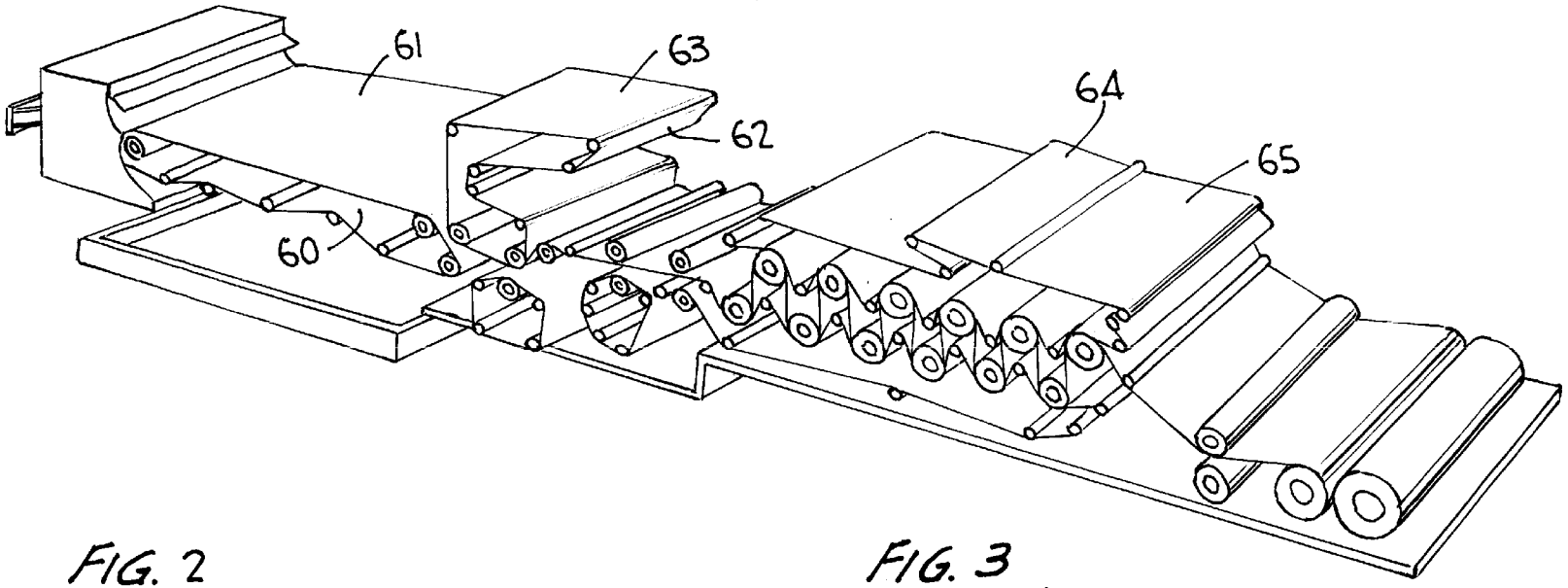
FIG. 1 is a diagrammatic representation of papermaking machine.
Figure 2:
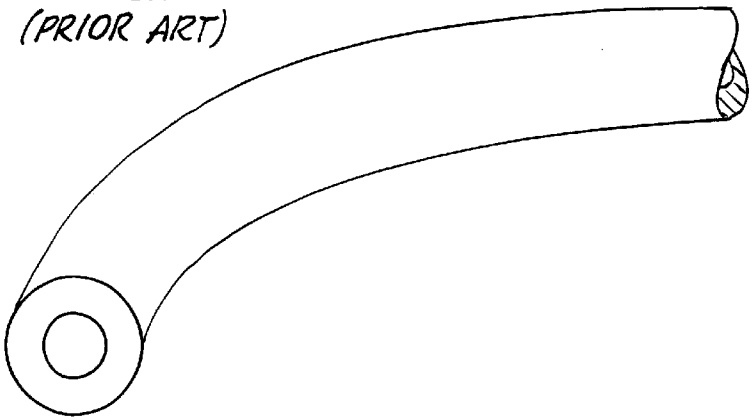
FIG. 2 (PRIOR ART)
FIG. 2 shows a top plan view of a typical prior art hollow monofilament yarn.

FIG. 1 displays a diagrammatic representation of a papermaking machine, on which fabrics constructed partially of yarn made in accordance with the present invention may be used.

The exemplary papermaking machine is shown for the purposes of illustration of the application of the yarn of the present invention to papermakers' dryer fabrics. As shown in FIG. 1, the machine includes a forming section 60 (having a forming fabric 61), a press section 62 (having a press felt 63), and a dryer section 64 (having a dryer fabric 65).

Figure 4:
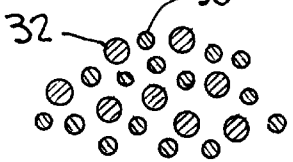
FIG. 4 is a cross-sectional view of one embodiment of the yarn of the present invention.
Figure 6:
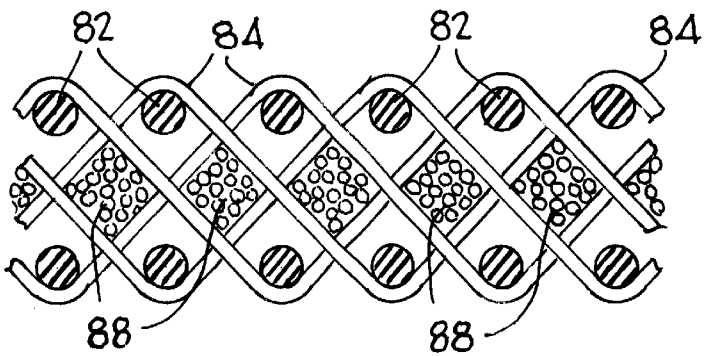
FIG. 6 is a cross-sectional view in the cross-machine direction of a dryer fabric of the present invention.
Figure 5:
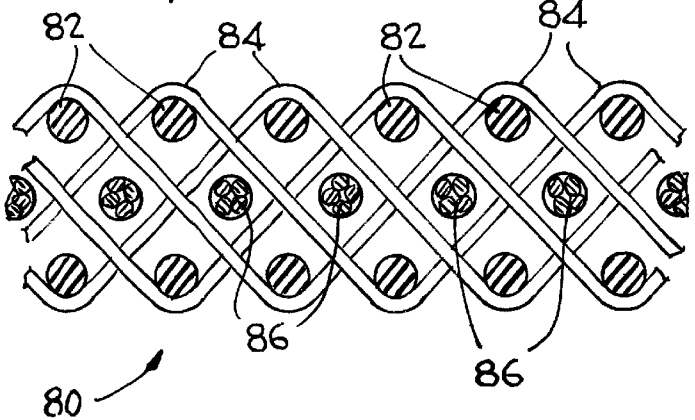
FIG. 5 (PRIOR ART)
FIG. 5 is a cross-sectional view of a prior art dryer fabric.

FIG. 5 illustrates a cross sectional view taken in the cross-machine direction of a prior art dryer fabric 80 having cross-machine-direction yarns 82, machine direction yarns 84, and cabled monofilament stuffer yarns 86. FIG. 6 illustrates a similar cross sectional view of the dryer fabric 81 according to the invention, similarly having machine direction yarns 82, cross-machine-direction yarns 84, and the stuffer yarns of the present invention 88. FIG. 4 is an end view of the yarn 88 according to the invention. As there illustrated, the yarn 88 may comprise filaments of several different diameters, as shown at 30 and 32; one of these is a central twisting carrier that serves as the central twisting carrier about which the other filaments of the yarn 88 are twisted.

Figure 3:
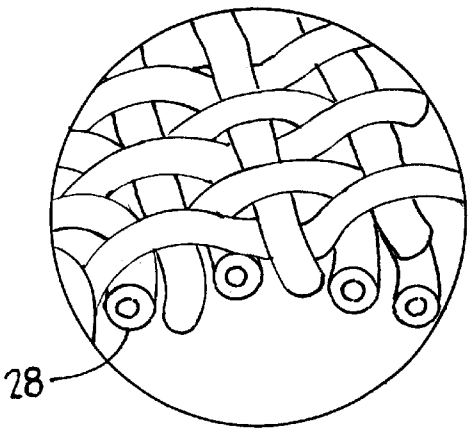
FIG. 3 (PRIOR ART)
FIG. 3 is a cross-sectional view in the cross-machine direction of a prior art fabric utilizing the hollow monofilament yarn of FIG. 2 as cross-machine direction stuffer picks.

From FIG. 6, the advantages of the dryer fabric utilizing the yarn of the present invention over the prior art dryer fabric of FIG. 3 or FIG. 5 become apparent. Compared to the single, fixed-diameter hollow monofilament yarns 28 of FIG. 3 or the cabled stuffer yarn 86 of FIG. 5, the embodiment of FIG. 6 illustrates the advantages of the intertwisted yarn 88 of the present invention in creating a dryer fabric which allows the papermaker increased control of permeability in the dryer section of the papermaking machine. As seen in the cross-sectional view in FIG. 4 of one embodiment of the yarn of the invention and in FIG. 6, the fact that the yarn of the invention comprises separate filaments allows the yarn to be deformed during weaving to fill the interstices of the fabric as completely as desired in order to controllably inhibit air flow through the fabric, and produce a superior sheet of paper.

In yet another embodiment of the invention, the intertwisted yarns of the present invention may be used as picks in the machine direction of a press fabric. As previously described, press fabrics are used in papermaking machines to support the moist, freshly formed paper web as it encounters a variety of rolls to extract water from the moist paper web. A press felt is formed through a needling process, whereby a batt material is applied to a base fabric and driven into inter-engagement with the fabric. As is known in the art, there is significant stress placed upon the press felt in the press section of the papermaker's machine.

The wound yarns of the present invention are inserted as picks in the press fabric, in much the same manner as has been previously described with respect to a dryer fabric. The fabric is subsequently needled with batt material. Optionally hot melt adhesive holds the stuffer picks into the press fabric.

In the present embodiment, improved anchorage of the batting material in the base fabric is effected by the inter-engagement of the batt fibers with the additional wound stuffer picks of the present invention during needling. Specifically, the multifilament picks of the present invention engage the batting material more tightly during needling as a result of the increased contact area. Additionally, because the machine-direction yarns are wound multifilament, the degree to which batt fibers become enmeshed and intertwined with these yarns is greater than that in prior art felts. This increased entwinement results in higher frictional forces between the batt fibers and the wound intertwisted picks, thus producing a higher degree of restricted lateral movement of batt fibers once needled. This embodiment provides an advantageous felt construction, offering improved felt durability and wear characteristics. Additionally adhesive can be used to increase the performance of the fibers.

Thus it will be readily apparent to those skilled in the art that the use of the intertwisted yarns of the present invention, and specifically the use of the intertwisted yarns of the present invention as stuffer picks in the dryer and in the scrim of press fabrics of a papermaking machine affords the papermaker enhanced control over the papermaking process such as the control of heat transfer and permeability in the dryer section and improved batt retention and wear qualities in the press section.

The preceding detailed descriptions of embodiments of the present invention are intended to provide examples of how intertwisted yarns may be used in accordance with the present invention, but they are not intended to limit the use to the applications described. Further embodiments may also be designed in accordance with the present invention. It is to be understood that numerous combinations of yarn types, yarn diameters, winding geometries and arrangements of yarns may be used with equal facility and effectiveness.

It is also to be understood that many other variations and modifications of this fabric construction, all within the scope of this invention, will readily occur to those skilled in the art. While the embodiments, as described above, have been illustrated in the form of dryer and press fabrics made up in simple duplex weaves, it will be understood that any appropriate multi-layer weave can be used which will enable the introduction of stuffer picks. By varying the geometry of the stuffer picks, a large variety of dryer and press fabrics of different characteristics can be achieved. Accordingly, the foregoing is intended to be descriptive only of the principles of the invention and is not to be considered a limitation thereof.

The yarn is made by pulling a central twisting carrier through the hollow center of each of several twisting filament-loaded supply spools positioned sequentially in a linear pattern, whereby preferably six or more twisting filaments are wrapped around the central twisting carrier. In a preferred embodiment the twisting filaments are balanced in matched pairs of clockwise and counter-clockwise wrapping filaments to balance the torque of the final yarn. The maximum number of total filaments in the finished yarn is approximately 100 filaments.

Figure 7:
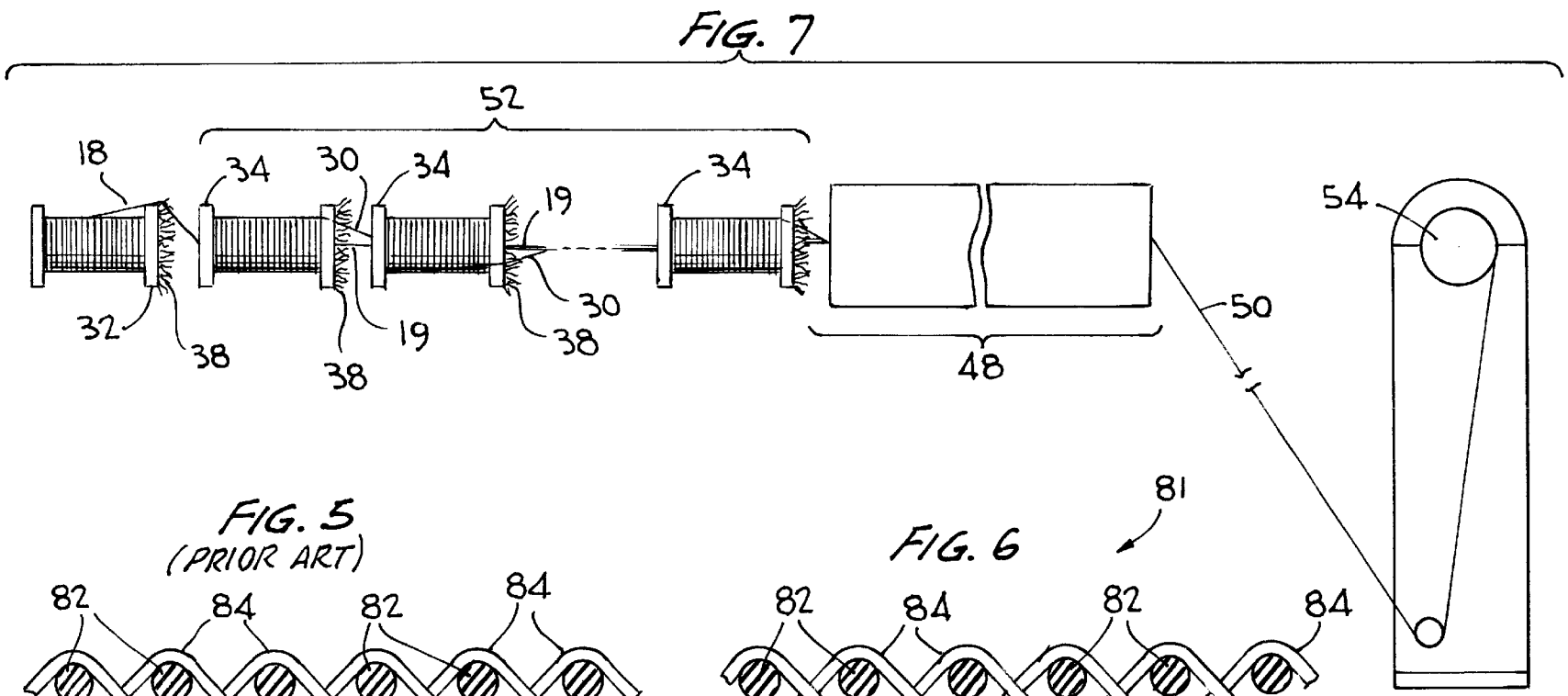
FIG. 7 is a fragmentary side schematic showing the spindle assembly used to make the yarn of the present invention.
Figure 8:
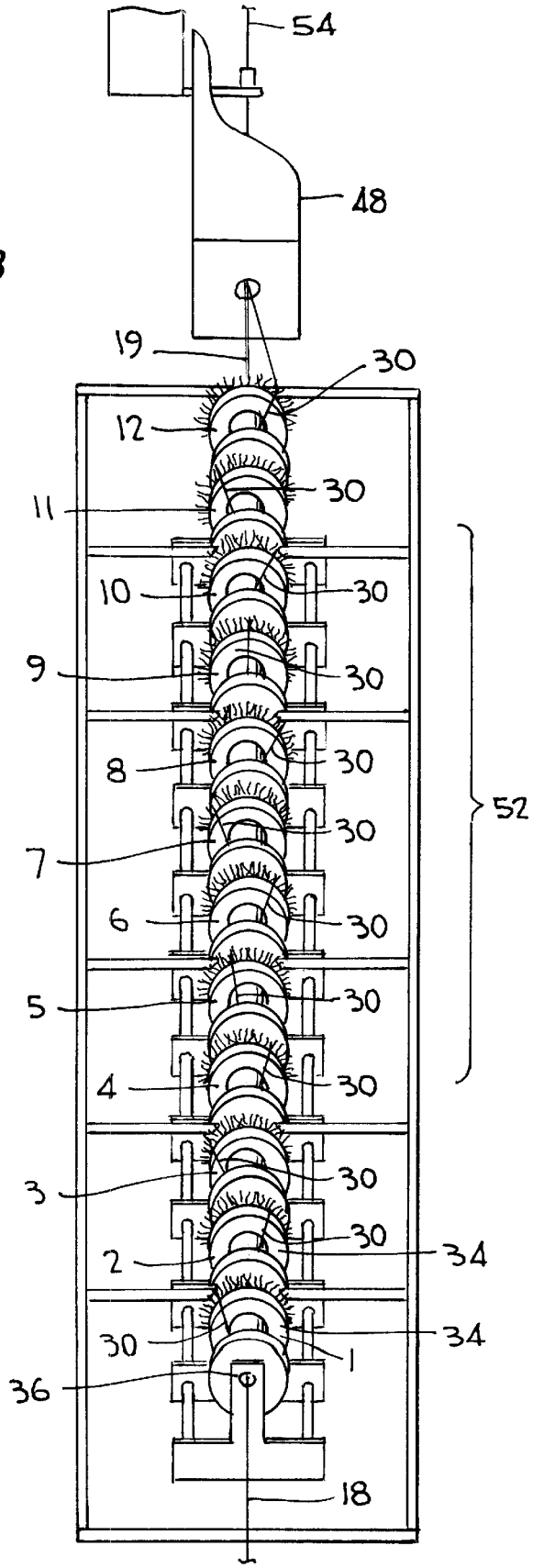
FIG. 8 is a perspective view of the spindle assembly used to make the yarn of the present invention.
Figure 9:
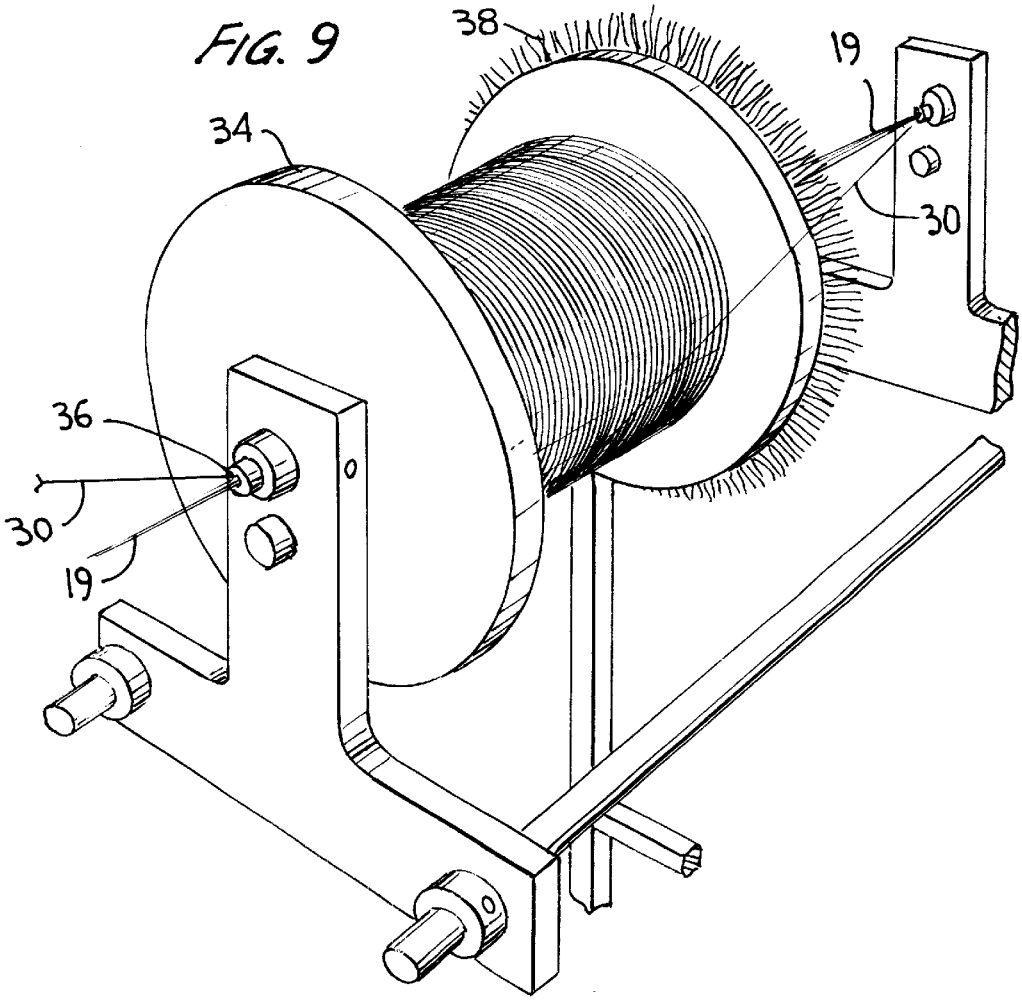
FIG. 9 is a view of the first supply spool in the spindle assembly.
Figure 10:
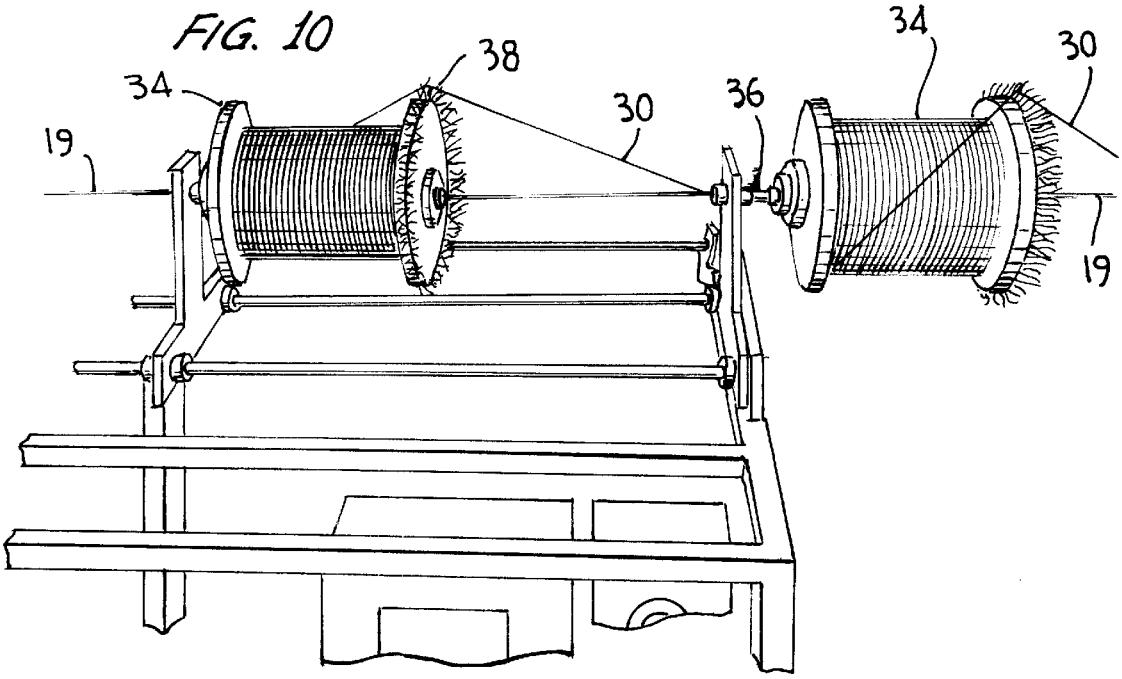
FIG. 10 is a view of two supply spools in the spindle assembly.

As shown in FIG. 7 and FIG. 8, the central twisting carrier 18 is advanced through a series of spindles 36 (FIG. 8.) in a spindle assembly 52. Each spindle 36 in the assembly 52 serves as an axle for a twisting filament-loaded supply spool 34. The spools 34 of assembly 52 do not rotate, but are static, and the filaments are pulled off the spools endwise, as illustrated. In one embodiment the central twisting carrier 18 passes through twelve spindles 36, with each spindle 36 supporting a static twisting filament-loaded supply spool 34. As the central twisting carrier passes through each supply spool 34 another twisting filament 30 is pulled off the twisting filament-loaded supply spool 34 endwise, that is, at 90 degrees from the tangential direction, and becomes part of a yarn precursor 19 comprising the central twisting carrier and the filaments 30 from the "upstream" spools.

If the twisting filaments 30 were merely pulled off spools oriented transversely to the direction of movement of the central twisitng carrier and through the spindles 36 along with the central twisting carrier 18, they would remain essentially parallel to one another. However, when a twisting filament 30 is pulled endwise off a static twisting filament-loaded supply spool 34 and through the subsequent spindle in the series, along with the yarn precursor comprising the central twisting carrier 32 and the filaments 30 from the upstream spools, the twisting filament 30 twists around the yarn precursor 19, increasing its diameter.

Since a twisting filament 30 is added to the yarn precursor 19 comprising the central twisting carrier 18 and the filaments 30 from the upstream spools at every spindle 36 in the assembly, the diameter of the yarn precursor 19 changes accordingly. The length of the twist of each filament around the yarn precursor is determined by the amount of twisting filament 30 on the corresponding twisting filament-loaded supply spool 34 (i.e. by the circumference of twisting filament-loaded supply spool 34) As used herein the "length of the twist" refers to the distance along the yarn precursor it takes for a yarn to start, e.g., at the top of the yarn precursor and go around the yarn precursor and end up at the top again. The smaller the circumference of the filament on the twisting filament-loaded supply spool 34, the shorter the length of the twist, and the larger the circumference of the spool 34, the longer the resulting length of the twist. Of course as the twisting filament 30 is pulled from the twisting filament-loaded supply spool 34, the circumference of the spool 34 will get smaller.

At the end of the spindle assembly the diameter of the yarn precursor is significantly larger than when it passed through the first spindle 36. This change in diameter also affects the length of the twist.

As shown in FIG. 7, and FIGS. 9–11, one end of each twisting filament-loaded supply spool is provided with an annular array of monofilament whiskers 38. The whiskers used in one embodiment of the invention are available as a brush from Wyrepak-Watkins. The whiskers are part of a patented device, described in U.S. Pat. No. 4,508,290. As the twisting filaments payoff the twisting filament-loaded supply spools, the tension of the twisting filaments is controlled by pulling them through the monofilament whiskers.

If desired, a number of twisting filaments can be wrapped around the yarn precursor with a shorter twist by driving at least one twisting filament-loaded supply spool with a motor to wind the filament around the yarn precursor. This might be desirable, for example, as an outer wrap, to keep the yarn neat during handling and weaving. By controlling both the speed of the pulley driving at least one twisting filament-loaded supply spool, and by controlling the speed of the take-up reel 54 (FIGS. 7 and 8), the number of wraps of the twisting filament around the yarn precursor 19 can be controlled.

In a preferred embodiment, the yarn precursor 19 is wrapped with twisting filament at a rate of between 2 and 100 wraps per linear inch.

Post-treating of the yarn may be used to further bind the assembly of filaments. This can include heat treating, resin coating, impregnation or the use of low melting temperature filaments or filaments coated with a low melting polymer within the assembly of filaments.

For example, after the yarn leaves the last spindle in the spindle assembly, the filaments of the yarn can be joined together with a temporary glue. The glue is strong enough to enable the yarn to be woven into a fabric, but weak enough to allow the filaments in the yarn to separate slightly during the weaving process, as desired. This separation of filaments or breakdown allows the filaments of the yarn to fill the interstices of the fabric, allowing control of the airflow through the fabric, and results in the formation of a superior sheet of paper.

More specifically, after the yarn precursor 19 is passed through at least the last spindle 36 in the spindle assembly, a temporary glue or adhesive may be applied to at least one filament. The purpose of applying a temporary glue is to hold the filaments together for weaving the yarn into the fabric. The glue might, for example be a urethane that is either heat or ultraviolet cured. The temporary nature of the glue allows the filaments in the bundle to be separated as the yarn is woven into a fabric. As described previously, this is desirable in the dryer fabric because the separated but still intertwisted filaments do a better job of filling the interstices of the fabric than the prior art stuffer yarns, providing increased control of the airflow through the fabric that results in the formation of a superior sheet of paper. While the inter-twisted structure will contain the bundle of filaments as a group, the individual monofilaments may migrate somewhat independently within a finite length of the stuffer pick. This allows filaments to fill the open voids between the other filaments of the fabric (see FIG. 6).

In addition to urethane, the glue that is applied may be selected from a member of the group consisting of ethylene vinyl acetate adhesive, polyamide adhesive, nylon adhesive, thermoset epoxy resin, thermoset vinyl ester resin, and thermoset polyester resin, and hot melt adhesives.

As an alternative to temporary glue, adhesive coated filaments or yarns may be provided to join the central twisting carrier yarns and the twisting filaments. The adhesive coated yarns may be in addition to the central twisting carrier 18 and twisting filaments 30, 32, or they may be selected from the central twisting carrier 18 and/or twisting filaments 32, 30.

The adhesive coating may be activated by a heat zone, shown schematically in FIG. 7 and FIG. 8 as an oven 48 and subsequently cooled prior to winding. The completed yarn 50 is heated in oven 48 to a temperature of about between 140° F. and 500° F., with the actual temperature to be determined by the nature of the glue or adhesive selected. The temperature should be high enough to produce a bond between the glue or hot melt adhesive and the twisting filaments which is strong enough to hold together during weaving, but weak enough to allow the filaments to separate after the yarn is woven into a fabric.

In another embodiment, the adhesive coated yarns may be wound on small diameter packages and fed into the system over end to provide a greater degree of inter-twisting.

Although several embodiments of the yarn of the invention have been disclosed, it is understood that any number of twisting filaments may be used, with a maximum of about 100 total filaments to produce the yarn and the majority of filaments must not be parallel to each other.

In addition, it will be understood that the twisting filaments and central twisting carrier may be of any shape, and are not limited to having a circular cross section. For example, the filaments may have a rectangular, trapezoidal, square, oval, or other shape. In addition, the twisting filaments and central twisting carrier need not be of uniform size, as shown by FIG. 4. Furthermore the twisting filaments may also be bundles of multifilaments or spun yarns.

To modify the inter-twist level and resulting compaction of the filament bundle one or more of the spools may be rotated by driving the hollow spindles while the fibers paying off the preceding bobbins pass through the hollow spindle holding the rotating spool or spools. For example, 12 spools of twisting filament, a monofilament, are mounted on hollow spindles in a linear relationship. Each spool is alternated so the twisting filament pays off over the head of the twisting filament-loaded supply spool in clockwise or counterclockwise direction causing the twisting filament to twist off in an "S" or "Z" direction.

Each twisting filament is fed into the next hollow spindle. If the twisting filament-loaded supply spools are numbered in a linear sequence as spool number 1, 2, 3, 4, . . . 12 (as labeled in FIG. 8), then one possible format is that the twisting filament from twisting filament-loaded supply spool 1 is rotating clockwise off the static spool, so that the filament 30 wraps the moving central twisting carrier 18, which is passing through the center of supply spool 1, in a clockwise direction. The combination of the central twisting carrier 18 and the first filament thus becomes the yarn precursor 19, which is then fed into the hollow spindle holding twisting filament-loaded supply spool 2. The twisting filament from spool 2 pays off counterclockwise and is wound around the yarn precursor 19 comprising the twisting filament 30 from spool 1 and the moving central twisting carrier 18, becoming part of the yarn precursor, and so on. That is, the yarn precursor 19, now comprising central twisting carrier 18 wrapped with two inter-twisted twisting filaments is then fed through the hollow spindle holding twisting filament-loaded supply spool 3 the twisting filament 30 from spool 3 pays off in clockwise direction and becomes part of the yarn precursor as fed to the next spindle, and so on. This arrangement continues until at twisting filament-loaded supply spool 12 the yarn precursor 19 comprises the central twisting carrier 18 and eleven inter-twisted twisting filaments wrapped by the twisting filament paying off twisting filament-loaded supply spool 12.

The result is a yarn comprising an inter-twisted bundle of a central twisting carrier and twelve filaments successively twisted thereover by pulling the twisting filament endwise off the end of the spool. The resultant twist per inch of the yarn as to each filament thereof is 1/ΠD or 1/C, where C is the length of yarn in the circumference of the package of the filament on the corresponding spool, that is, its diameter D multiplied by the constant, Π (pi), which is approximated here as 3.1416.

In the above example all spools are static and only the action of the yarn provides the twisting or wrapping action about the filament(s) passing through the hollow spindle.

The twisting or wrapping action is fixed in direction "s" or "z" by the direction of pay off the twisting filament-loaded supply spool and the twisting or wrapping rate is limited by the diameter of the wound filament on the twisting filament-loaded supply spool from which the filament is "Peeled". Accordingly the inter-twisting or wrapping density or spacing remains constant and independent of the throughput speed of the passing filament(s).

Figure 11:
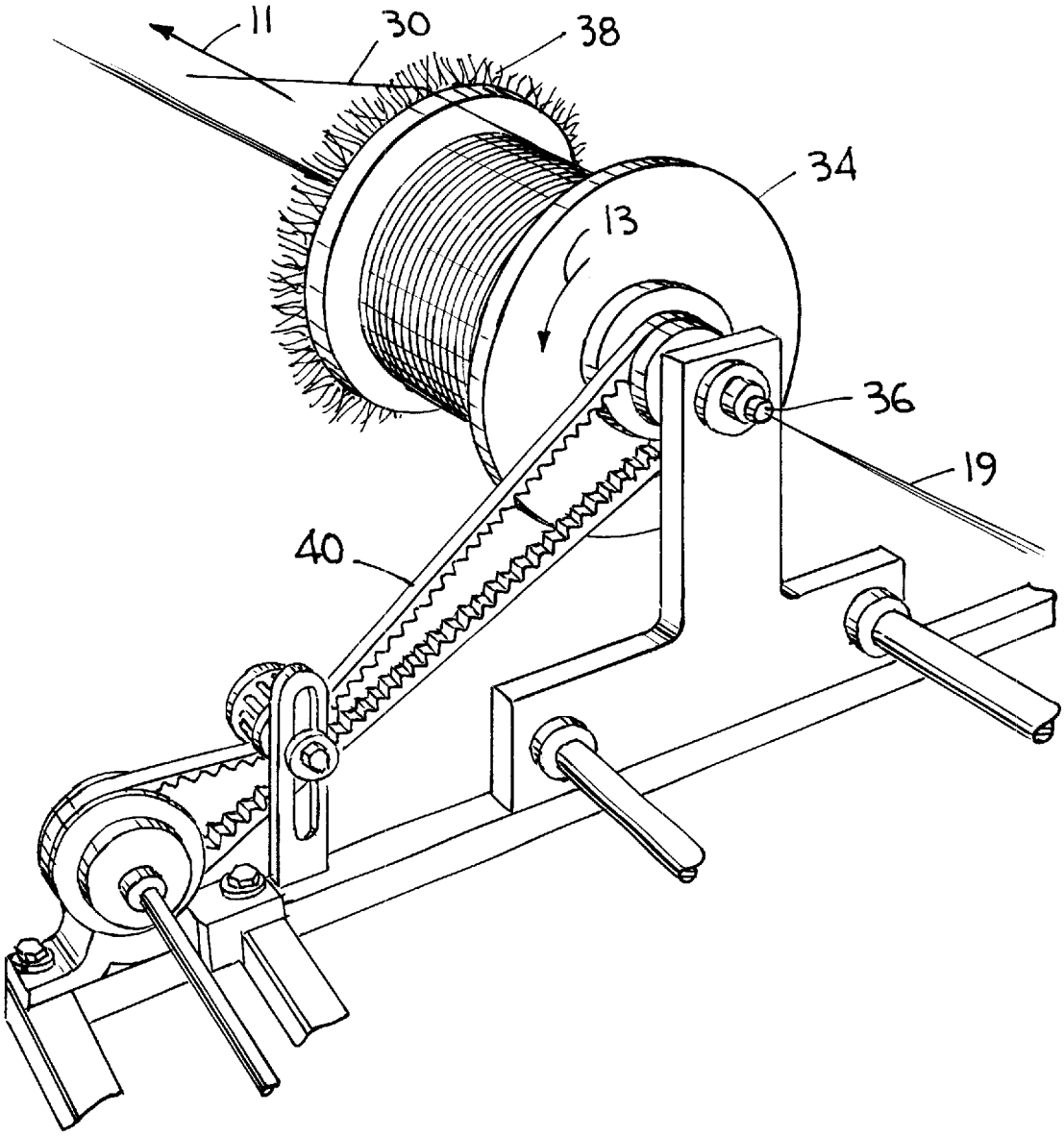
FIG. 11 is a view of one of the last two supply spools, which may be motor-driven.

Another configuration of the invention would be to rotate one or more twisting filament-loaded supply spools by driving at least one of the hollow spindles with a motor driven belt 40 as shown in FIG. 11. If spool 12 is driven counterclockwise as indicated by arrow 13 at a rate of 300 RPM, and the yarn precursor 19 passes through the corresponding spindle at 36 at 50 IPM (inches per minute) in the direction of arrow 11 then twisting filament 12 will twist and wrap about the yarn precursor at 300/50=6 wraps per inch about the bundle.

An embodiment of the method of making a yarn of the invention is as follows.

As shown in FIG. 7 and FIG. 8, the central twisting carrier 18 is fed from a central twisting carrier spool 32; the central twisting carrier 18 can be fed from a spool 32 tranverse to the orientation of the spools from which the twisting filaments are dispensed, as shown, if it is desired that the central twisting carrier is not itself twisted; alternatively, the spool 32 from which the central twisting carrier is dispensed can be oriented as are the spools 34 of the twisting filament, in which case the central twisting carrier will also be twisted. The first twisting filament spool 34 delivers the twisting filament 30, which is wrapped around the central twisting carrier 18 to form the yarn precursor 19, which then passes through the hollow of the subsequent spool 34, and so on to form the yarn. The spools 34 are fixed and not allowed to rotate, and the filaments are is pulled off spools 34 endwise, that is, at an angle of 90 degrees from the axis of the spool.

EXAMPLE

Twelve active ends of 0.008 inch polyester monofilaments, (HC;Type 900C) were processed with alternating "S" and "Z" pay-off from the spools.

| | Yarn position | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Direction | S | Z | S | Z | S | Z | S | Z | S | Z | S | Z |

Positions 11 and 12 had the 0.008 inch monofilament, but each was previously coated with 31% (wt.) EVA hot melt resin. The twisting filament-loaded supply spool at position 12 was driven at a rotation of 746 RPM as the inter-twisted filaments (eleven) comprising the central twisting carrier passed through the hollow spindle 12 at a linear speed of 125 FPM (feet per minute). As explained previously, the speed of the central twisting carrier is determined by the speed of the take-up reel. It is important to note, that the rotation rate should be varied depending on the type of twisting filament being used. In a preferred embodiment, the central twisting carrier is wrapped with twisting filament at a rate of between 2 and 100 wraps per linear inch of central twisting carrier passing through a twisting filament-loaded supply spool.

The completed assembly of twelve monofilaments was then heated in a series of radiant heat tubes totaling 14 feet in length at a temperature of 415° F. After passing in an ambient air cooling zone the yarn was precision wound to a 3¼ inch×11 inch tube.

The yarn was woven directly from the above noted tube as a stuffer pick in a two-layer, all monofilament dryer fabric. The fabric was heat set and air permeability was tested and compared to a section of fabric woven using the standard 4×3 cabled 0.008 inch monofilament stuffer at the same picks per inch.

The comparison showed the inter-twisted monofilament structure which is the object of this invention provided a CFM of 70 compared to 100 for the standard cabled monofilament.

The process of making a Dryer fabric consisted of the following step of: First, a yarn is made using an embodiment of the method described above, wherein the first twisting filament is pulled off the end of the first twisting filament-loaded supply spool to wrap in a clockwise direction around the central twisting carrier, and the second twisting filament is pulled off the second twisting filament-loaded supply spool to wrap in a counterclockwise direction around the central twisting carrier. The central twisting carrier is passed through twelve twisting filament-loaded supply spools, as the twisting filament from each supply spool pays off in alternate directions, clockwise and counterclockwise. The central twisting carrier may be comprised of two or more parallel filaments. The central twisting carrier filaments and the twisting filaments may be either nylon or polyester. The number of revolutions per minute of at least one of the twisting filament-loaded supply spools is controlled by a motor-driven pulley. The central twisting carrier is wrapped at a rate of between 2 and 100 wraps per linear inch of central twisting carrier passing through a twisting filament-loaded supply spool. A temporary glue is applied to at least the last twisting filament being wrapped around the central twisting carrier. The yarn is passed through an oven to form a temporary bond between the glue and the twisting filaments. The yarn is cooled and coiled on a take-up reel. The yarn is then inserted as stuffer picks in making a dryer fabric.

The following process discusses the Making A Press Felt using the steps of: First a yarn is made according to any one of the above embodiments of the invention. Then the yarn is woven into a base fabric. Batt fibers are then needled into the base fabric, which provides improved anchorage for the batt fibers. Hot melt or thermoplastic resin coated filaments may be incorporated to provide better adhesive properties to the scrim to better bond the needled fibers.

While the present invention has been described in connection with preferred embodiments thereof, it will be apparent to those skilled in the art that many changes and modifications may be made without departing from the true spirit and scope of the and all equivalents are included within the scope of the following claims.

I claim:

1. A method of forming a yarn comprising at least four filaments of a desired material wrapped about one another, comprising the steps of:

providing a like number of spools of filaments of said material, said spools having hollow tubular cores;

arranging said spools in a series along a forming line, with their axes aligned generally along said line, and with successive spools oriented oppositely to one another with respect to the direction of winding of said filaments thereon;

drawing a first central twisting carrier of diameter similar to said filaments through the hollow cores of each of said spools in said series;

drawing the filaments of said material endwise off each spool in said series in turn, and drawing each filament together with said central twisting carrier and the filaments drawn from the spools earlier in said series through the hollow cores of each of the spools later in said series, such that a yarn precursor comprising said central twisting carrier and said filaments drawn from the spools earlier in said series is successively wrapped in opposite directions by a further filament as the yarn precursor is drawn through the hollow core of each spool in said series, forming a yarn; and collecting said yarn for weaving into a fabric;

wherein said spools are maintained static during said step of drawing the filaments of said material endwise off said spool, whereby the pitch by which a given filament is wrapped around the yarn precusor comprising the central twisting carrier and the filaments drawn from the spools earlier in said series is proportional to the circumference of wrapped filament material on the spool from which said given filament is drawn.

2. The method of claim 1, wherein said desired material is a monofilament fiber selected from the group comprising polypropylenes, polyesters, or nylon.

3. The method of claim 1, wherein said central twisting carrier of said yarn is a filament of said desired material.

4. The method of claim 3, wherein said filament of said desired material forming said central twisting carrier of said yarn is pulled endwise off a spool, so that said central twisting carrier is twisted.

5. The method of claim 1, comprising the further step of applying an adhesive to said yarn that is sufficiently strong to hold said filaments in alignment with one another prior to and during weaving of said yarn into a fabric, but which is weak enough to allow separation of said yarn into filaments during a compaction step, whereby the filaments of said yarn conform to the other yarns of said fabric.

6. The method of claim 5, wherein said adhesive is selected from the group comprising urethanes, ethylene vinyl actate, polyamide adhesive, nylon adhesive, thermoset epoxy resin, thermoset vinyl ester resin, thermoset polyester resin, and hot melt adhesives.

7. The method of claim 6, wherein said adhesive is heat-activated, and said method comprises the further step of heating the yarn precursor to a temperature of between 140° and 500° F. prior to said collection step.

8. The method of claim 1, comprising the further steps of disposing at least one additional spool of a filament of said material in said series after said static spools, wrapping said filament of said material on said additional spool around the yarn precursor comprising the central twisting carrier and the filaments drawn from the spools earlier in said series as said yarn precursor is drawn past said additional spool, and said additional spool being driven for rotation about its axis as said filament of material is drawn off said additional spool, whereby the pitch by which a given filament is wrapped around the yarn precursor is determined by the rate of said rotation and the rate at which said yarn precursor is drawn past said additional spool.

9. The method of claim 1, comprising the further step of disposing a brush comprising a number of whiskers extending radially outwardly on the end of each of said spools over which the corresponding filaments are drawn, to control the regular pay-out of said filaments.

10. A papermaker's yarn made using the steps of claim 1.

11. A dryer fabric made by weaving a yarn made by the steps of claim 1 into a fabric.

12. The dryer fabric of claim 11, wherein said fabric is woven using said yarn as well as filaments of additional material, said yarn being employed as a stuffer yarn in said dryer fabric.

13. A press felt made by weaving a yarn made by the steps of claim 1 into a fabric, and needling further fibers into said fabric to form a felt.

* * * * *